US009845654B2

(12) United States Patent
Hopper et al.

(10) Patent No.: US 9,845,654 B2
(45) Date of Patent: Dec. 19, 2017

(54) SUBSEA SUPPORT

(71) Applicant: Cameron International Corporation, Houston, TX (US)

(72) Inventors: Hans Paul Hopper, Aberdeen (GB); Johnnie Kotrla, Katy, TX (US); John T. Evans, Houston, TX (US)

(73) Assignee: Cameron International Corporation, Houston, TX (US)

( * ) Notice: Subject to any disclaimer, the term of this patent is extended or adjusted under 35 U.S.C. 154(b) by 3 days.

(21) Appl. No.: 14/972,082

(22) Filed: Dec. 16, 2015

(65) Prior Publication Data

US 2016/0186517 A1 Jun. 30, 2016

(30) Foreign Application Priority Data

Dec. 29, 2014 (GB) ..... 1423301.9

(51) Int. Cl.

| | |
|---|---|
| ***E21B 33/037*** | (2006.01) |
| ***E21B 17/01*** | (2006.01) |
| ***E21B 33/06*** | (2006.01) |
| ***E21B 17/02*** | (2006.01) |
| ***E21B 33/038*** | (2006.01) |
| ***E21B 43/013*** | (2006.01) |
| ***E21B 19/00*** | (2006.01) |
| ***E21B 33/064*** | (2006.01) |
| ***E21B 17/08*** | (2006.01) |

(52) U.S. Cl.

CPC ..... *E21B 33/037* (2013.01); *E21B 17/01* (2013.01); *E21B 17/085* (2013.01); *E21B 33/038* (2013.01); *E21B 33/06* (2013.01); *E21B 43/013* (2013.01)

(58) Field of Classification Search

None

See application file for complete search history.

(56) References Cited

U.S. PATENT DOCUMENTS

| | | | |
|---|---|---|---|
| 3,981,357 | A | 9/1976 | Walker et al. |
| 4,466,487 | A | 8/1984 | Taylor, Jr. |
| 5,971,076 | A | 10/1999 | Taylor et al. |

(Continued)

FOREIGN PATENT DOCUMENTS

| | | | |
|---|---|---|---|
| EP | 0088608 | A2 | 9/1983 |

OTHER PUBLICATIONS

Combined Search and Examination Report; Application No. GB1423301.9; dated Jan. 26, 2015; 5 pages.

(Continued)

*Primary Examiner* — Matthew R Buck
*Assistant Examiner* — Douglas S Wood
(74) *Attorney, Agent, or Firm* — Fletcher Yoder, P.C.

(57) ABSTRACT

A subsea support system comprises: at least one component (501) which is configured to be fixedly connected to a pressure conductor (101) in a seabed; and a subsea support (601) which is configured to compliantly support the at least one component (501); wherein, when the at least one component (501) is fixedly connected to the pressure conductor (101), substantially all of a mechanical load (T) which is applied to the subsea support (601) is transmitted by the subsea support (601) to the seabed while the at least one component (501) is substantially free of the mechanical load and remains fixed relative to the pressure conductor (101).

20 Claims, 8 Drawing Sheets

(56) References Cited

U.S. PATENT DOCUMENTS

| | | | | |
|---|---|---|---|---|
| 7,328,741 | B2 * | 2/2008 | Allen | E21B 44/00 166/335 |
| 7,578,349 | B2 * | 8/2009 | Sundararajan | E21B 33/063 166/344 |
| 9,353,602 | B2 * | 5/2016 | Kongshem | E21B 41/0007 |
| 9,416,797 | B2 * | 8/2016 | Van Wijk | E21B 33/06 |
| 9,441,426 | B2 * | 9/2016 | Gutierrez-Lemini | E21B 17/085 |
| 9,650,855 | B2 * | 5/2017 | Caldwell | E21B 33/038 |
| 2011/0308858 | A1 * | 12/2011 | Menger | E21B 7/067 175/24 |
| 2013/0118755 | A1 | 5/2013 | Kotrla et al. | |
| 2014/0374115 | A1 | 12/2014 | Kebadze et al. | |
| 2015/0233202 | A1 * | 8/2015 | Caldwell | E21B 33/038 166/340 |

OTHER PUBLICATIONS

PCT International Search Report and Written Opinion; Application No. PCT/US2015/066512; dated Apr. 7, 2016; 12 pages.

* cited by examiner

SUBSEA SUPPORT

CROSS REFERENCE TO RELATED APPLICATION

This application claims priority to and benefit of Great Britain Application No. GB1423301.9, entitled "SUBSEA SUPPORT", filed Dec. 29, 2014, which is herein incorporated by reference in its entirety.

BACKGROUND

The present invention relates to a subsea support and a subsea support system.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Figure 1:
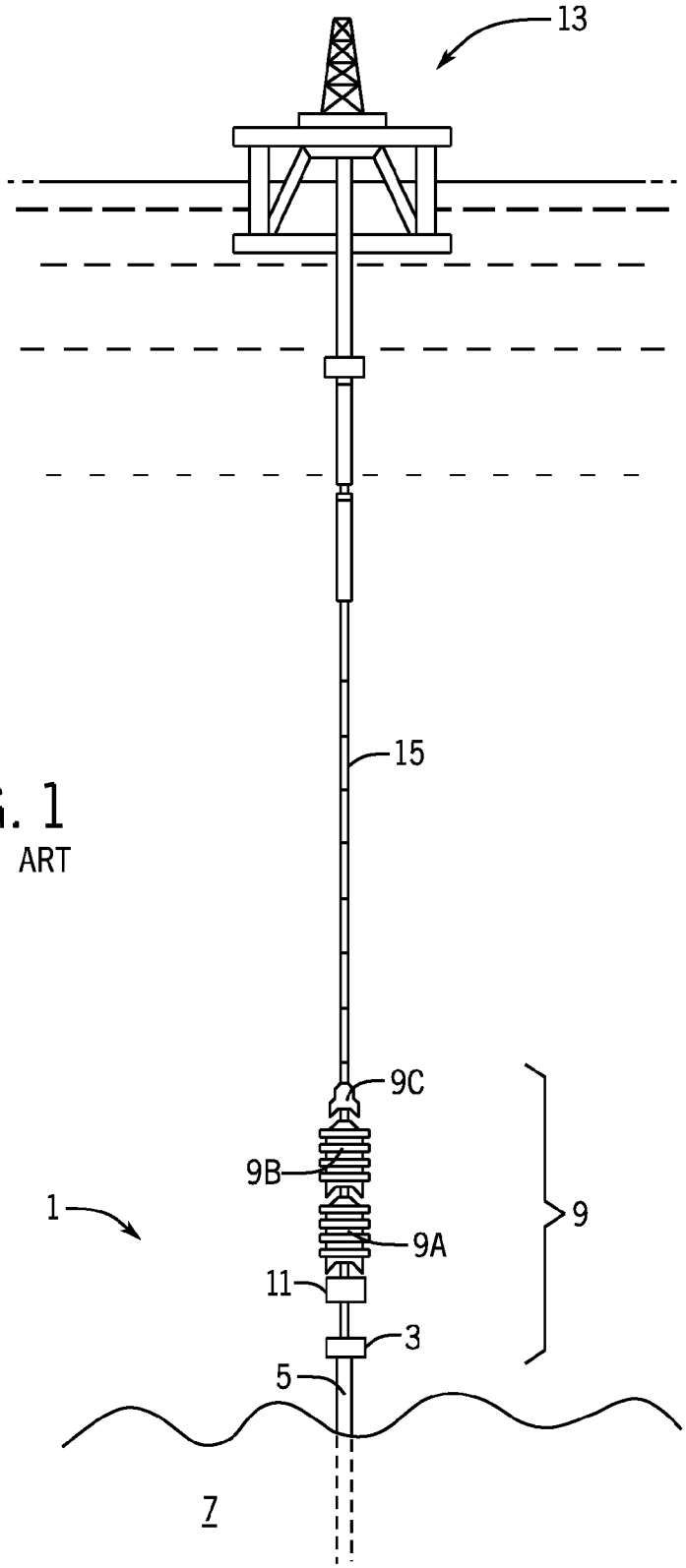
FIG. 1 PRIOR ART
FIG. 1 shows a schematic depiction of a conventional subsea drilling well and drill rig.

Referring to FIG. 1, in a conventional subsea drilling well 1 a wellhead 3 is connected to a conductor and high-pressure casings 5 which extends from a formation in the seabed 7. A blow-out preventer (BOP) stack 9 is attached to the wellhead 3 by a connector 11 and comprises a BOP ram package 9*a* containing high-pressure rams, a medium pressure annular 9*b*, and a lower marine riser package (LMRP) 9*c*. The BOP stack 9 is operative to shut-off or control the well formation pressure, to maintain well control or in the event of an unplanned occurrence.

A floating vessel, or drill rig 13, is used to complete the subsea well 1 and perform drilling operations. A riser pipe (or "marine riser") 15 comprises several sections of pipe and connects the drill rig 13 to the LMRP 9*c*, in order to provide a guide for a drill stem of the drill rig 13 to the wellhead 3 and to conduct drilling fluid from the well 1 to the drill rig 13. The LMRP 9*c* may be configured to be disconnected from the rest of the BOP stack, for example in the event of an emergency, to release the riser pipe 15 and drill rig 13.

Weather, waves and ocean currents act upon the drill rig 13 and riser pipe 15, loading them with forces in numerous directions. The drill rig 13 may be moored in place or have a dynamic positioning system, but in either case the drill rig 13 may stray away from a spot directly over the well 1. Although tensioners and flexible joints may be provided to compensate for movement of the drill rig 13 relative to the well 1, the movement and/or current effects tend to impart cyclical loads to the BOP stack 9, wellhead 3, and conductor and casings 5 in the form of tension, bending, and torsion. The cyclic angle movement, bending moments and tension oscillation are all transmitted though the BOP stack 9, connector 11, wellhead 3, and conductor and casings 5, leading to fatigue damage in the conductor and casings 5 below the wellhead 3. The first 30 m (about 100 feet) into the seabed is the most critical, and a failure in the pressure-containing section of a partly-drilled well could have catastrophic results. Also, excessive bending moments can occur when the drill rig 13 remains connected to the BOP stack 9 in extreme weather, or in a "loss-of-station keeping" event wherein the drill rig 13 is moved away from the well 1 without first disconnecting the riser pipe 15, resulting in bending the wellhead 3 over. Also, currents and tidal forces may bow or bend the riser pipe 15. These loads are too small to cause immediate, catastrophic damage, but can, over time, cause fatigue of the well components, leading to cracking of structural members and possibly ultimate failure of the wellhead system.

Historically, blow-out preventer (BOP) stacks have been connected to the wellhead with a large pre-load, in order to transfer the load applied by the drill rig into the wellhead as described. In recent years the applied loads have become larger, due to an increase in size of the BOP stacks and drill rigs, deeper water, higher pressures, deeper wells and problematic formations. For example, deep-water equipment is now being manufactured for a water depth of about 3,000 m (about 10,000 feet), rated for about 103 MPa (about 15,000 psi) working pressure, and a total well depth of around 11,000 m (about 35,000 feet). The increases apply also to equipment used in shallower waters as far as well depth and pressures are concerned. In order to meet the increase in the magnitude of the loads, wellhead manufacturers have designed larger, stronger wellhead equipment. For example, the diameter of the conductor has been increased from 0.762 m to 0.914 m (30 to 36 inches). As the equipment and loads have grown yet larger, conductor diameter is now being increased again to 0.965 mm, 1.067 m, or even 1.219 m (38, 42 or 48 inches). In addition, the capability to handle more casing strings has resulted in a new breed of larger, heavier wellheads, which place even greater demands on the conductor and casings.

Riser analyses are performed to determine the loads generated by the drilling rig and riser system on the pressure-handling components of the well. The results are used in extensive fatigue analyses to determine the fatigue life of the wellhead system and identify an operating window for the drill rig to drill, complete, work over, and abandon a wellhead system, without risk of fatigue failure. However, the operating window is often exceeded for a variety of reasons, like severe weather, extended drilling schedules, and underestimated production lifetimes for these wells.

For these reasons, it would be desirable to reduce the loads applied to the pressure-handling components of the well, for example by isolating the pressure loads to the pressure-containing wellhead equipment, and transferring mechanical tension, bending and torsional stresses to the seabed instead of the wellhead equipment.

The invention is set out in the accompanying claims.

According to an aspect of the invention, there is provided a subsea support system, comprising: at least one component which is configured to be fixedly connected to a pressure conductor in a seabed; and a subsea support which is configured to compliantly support the at least one component; wherein, when the at least one component is fixedly connected to the pressure conductor, substantially all of a mechanical load which is applied to the subsea support is transmitted by the subsea support to the seabed while the at least one component is substantially free of the mechanical load and remains fixed relative to the pressure conductor.

Entirely contrary to the conventional well described herein above, wherein the components (e.g. BOP stack) attached to the pressure conductor casing perform dual roles of pressure containment and resistance to external mechanical load, according to the claimed invention a subsea support absorbs the mechanical load while the supported component is substantially unaffected by the load and remains fixed relative to the pressure conductor. In other words, the subsea support isolates the component and the pressure conductor from the external loads and stresses, thereby reducing the risk of damage to the critical pressure elements of the well.

The provision of a subsea support which exploits the realization, that external (e.g. riser) loads may be decoupled from the pressure-containing components in the well, represents a radical departure from industry practice, which has for decades been biased toward the well-trusted solution of enlarging further the pressure-handling components in order to make them resistant to the increasing loads and stresses placed upon them. Moreover, the subsea support allows a return to a smaller pressure conductor casing, if required, since the loads are no longer transferred to the casing.

The compliant support may allow translation and/or rotation of the subsea support relative to the at least one component under the mechanical load. The compliant support may be provided by at least one compliant element, which connects the at least one component to the subsea support.

The at least one component may be a pressure-containing component, which is configured to be fluidly connected to the pressure conductor. The pressure-containing component may be configured to control the pressure of a fluid received from the pressure conductor. The pressure-containing component may comprise a fluid shut-off and/or a circulation module for controlling a well's drilling and/or formation fluid. The subsea support system may be configured to control the fluid in the pressure-containing component when the mechanical load applied to the subsea support exceeds a predetermined value. The subsea support system may include sensors for detecting the predetermined value of the mechanical load. The pressure-containing component may comprise a blow-out preventer (BOP), a wellhead, a subsea production tree, or a manifold. The blow-out preventer (BOP) may include a lower marine riser package (LMRP). The subsea production tree may include an emergency disconnect package (EDP).

The subsea support system may include a connection for connecting the subsea support to a conduit or line, for example a riser of a drilling rig, by which the mechanical load may be applied. The connection may comprise a pivot and/or telescopic connection which allows bending or translation of the subsea support relative to the at least one component. The subsea support system may comprise a coupling which is configured to separate the conduit or line from the subsea support at a predetermined value of the mechanical load. The connection may be configured to allow linear movement of the subsea support relative to the at least one component, for example along an imaginary axis which is normal with respect to the seabed. The lower marine riser package (LMRP) may be configured to be connectable to the conduit or line. The emergency disconnect package (EDP) may be configured to be connectable to the conduit or line.

The subsea support system may include a plurality of said components, and a plurality of stackable elements or modules configured to support the components.

The subsea support may comprise a lattice-type framework.

According to another aspect of the invention there is provided a subsea support for a component which is fixedly connected to a pressure conductor in a seabed, the subsea support being configured to compliantly support the component, so that substantially all of an external mechanical load which is applied to the subsea support is transmitted by the subsea support to the seabed while the component is substantially free of the external mechanical load and remains fixed relative to the pressure conductor.

Figure 2A:
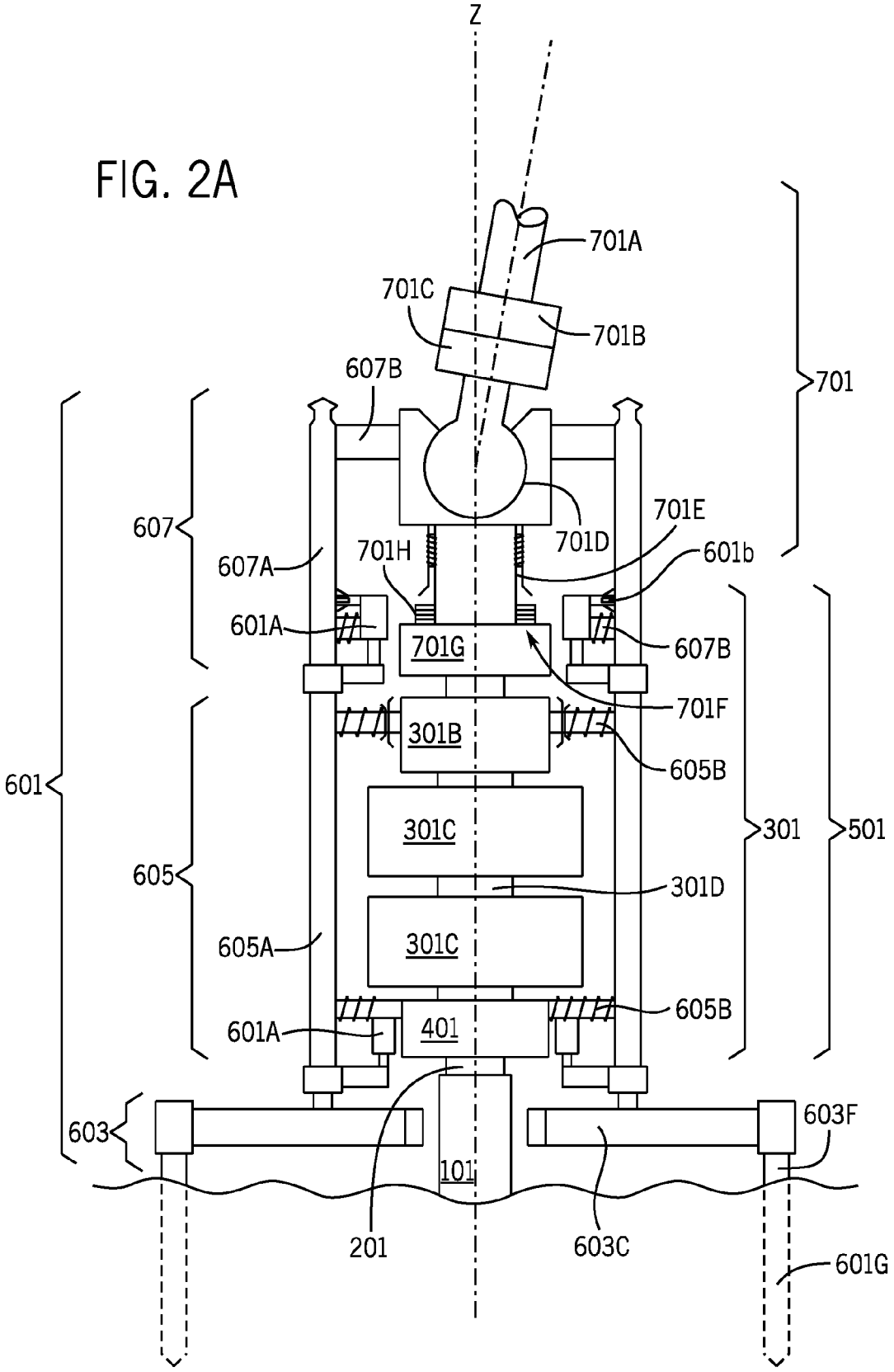
FIGS. 2*a-d* show schematic depictions of a subsea support system in accordance with an embodiment of the invention.

Referring to FIG. 2*a*, in a subsea drilling well there is a conductor, casing, or pipe 101 fixed in a seabed formation and cemented in place. The pipe 101 has an internal diameter of 0.732 m (30 inches) and extends approximately 1.8 m (about six feet) from the seabed in a substantially vertical orientation. The pipe 101 is a pressure-conductor and casing which is arranged to convey high-pressure fluids to and from the formation. In this exemplary embodiment, a wellhead 201 is rigidly attached to the pipe 101, and a lower end of a blow-out preventer (BOP) stack assembly 301 is rigidly attached to the wellhead 201 by a connector 401. The BOP stack assembly 301 comprises a lower marine riser package (LMRP) 701, a medium-pressure BOP annular 301*b*, and a high-pressure BOP ram assembly 301*c*, all connected in such a way that there is a continuous bore 301*d* extending from the lower end of the BOP stack assembly 301 through to the upper end of the LMRP 701, the bore being concentric with a vertical axis Z of the pipe 101 and configured to convey fluid from and to the pipe 101. The BOP stack assembly 301 is operative to shut-off or control the well pressure, for example to control the well or in the event of an unplanned occurrence.

Together, the wellhead 201, connector 401, and BOP stack assembly 301 comprise a subsea component 501.

Figure 2B:
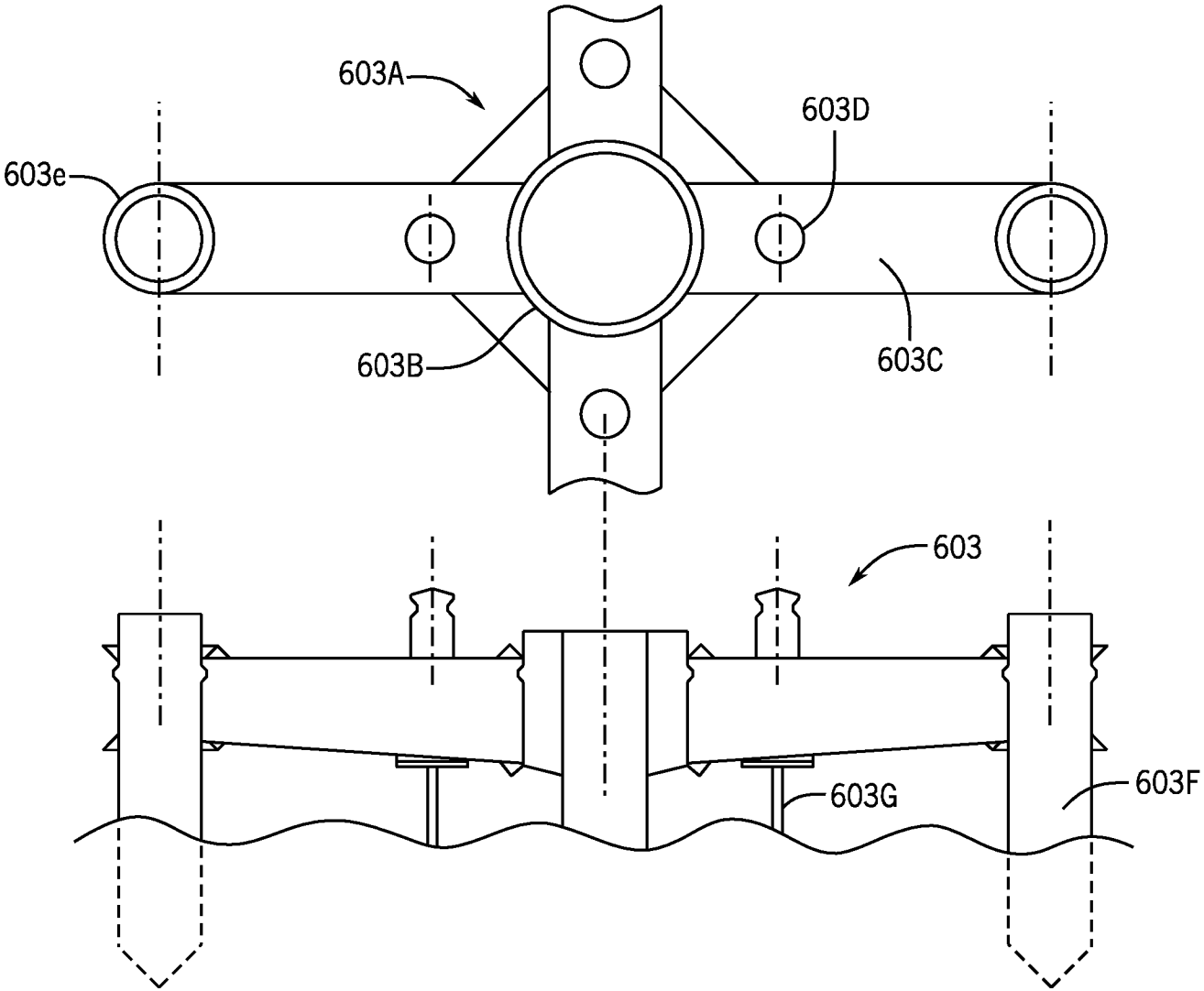

Referring now also to FIG. 2*b*, in this embodiment a structural support 601 comprises a base 603, including a circular central portion 603*a* including a removable bush 603*b* for receiving the pipe 101 and decoupling the base 603 from the pipe 101 after cementing or piling. A set of four spider-like, I-beam leg elements 603*c* extend radially outwardly of the circular central portion 603*a* in a horizontal plane, each leg element 603*c* including an inboard mounting housing 603*d* located about one third along its length, and an outboard mounting housing 603*e* at its outer extremity. Feet elements 603*f* extend downwardly through the respective outboard mounting housings 603*e* in order to anchor the base 603 in the seabed. Undersides of the leg elements 603*c* are further supported by platform pads and levelling jacks 603*g* anchored in the seabed.

Referring again to FIG. 2*a*, the structural support 601 further comprises a lower module 605, including a set of four spaced, tubular elements 605*a*, each connected to and extending upwardly from a respective inboard mounting housing 603*d* of the base 603, so as to surround the medium-pressure BOP annular 301*b*, the high-pressure BOP ram assembly 301*c*, and the connector 401. The tubular elements 605*a* are attached to the subsea component 501 (comprising the wellhead 201, connector 401, and BOP stack assembly 301) by a set of mounts, or compliant connectors 605*b*, which allow movement of the lower module 605 relative to the subsea component 501, as will be described further herein below.

The structural support 601 further comprises an upper module 607, stacked on top of the lower module 605 and including another set of four spaced, tubular elements 607*a*, each connected to and extending upwardly above a respective tubular element 605*a* of the lower module 605, so as to surround the LMRP 701. The upper ends of the upstanding tubular elements 607*a* are connected to one another by a set of horizontally-extending bracing struts 607*b*. The tubular elements 607*a* are attached to the LMRP 701 by a further set of mounts, or compliant connectors 607*b*, which allow movement of the upper module 607 relative to the LMRP 701 pressure components 701*f*, 701*g*, as will be described further herein below.

Thus, in this exemplary embodiment, the structural support 601 comprises a support frame which surrounds the subsea component 501 and the pipe 101. Furthermore, the outboard mounting housings 603*e* and feet elements 603*f* are located outside of the footprint of the subsea component 501 so as to provide a stable base of the frame support.

In this embodiment, the outboard mounting housings 603*e* each comprise a latch and lock for securing the structural support 601 to the respective feet elements 603*f*. The feet elements 601*f* comprise piles 601*g* which are driven and cemented into the seabed. The piles 601*g* may extend vertically down into the seabed, or may be arranged as "cross piles" which extend at an angle in order to increase the resistance to side loads.

The compliant connectors 605*b*, 607*b*, which join the upper and lower modules 605, 607 of the structural support 601 to the subsea component 501, allow the structural support 601, when subjected to an external mechanical load, to be moved relative to the subsea component 501, which remains fixed in space. With respect to the subsea component 501, the movement of the structural support 601 may be longitudinal (i.e. along the Z axis), lateral (i.e. normal to the Z axis), or rotational (i.e. about the Z axis), or any combination of these. Within the elastic limits of the compliant connectors 605*b*, 607*b*, the loaded structural support 601 can be moved relative to the subsea component 501, and then returned to its original position when the load is removed. Thus, the subsea component 501 is structurally independent of the structural support 601.

In this embodiment, sensors 601*b* are provided on the structural support 601 and arranged to detect an unsafe condition with regards to the structural integrity of the structural support 601. For example, the sensors 601*b* may detect an excessive level of strain or distortion in the structural support 601.

Still referring to FIG. 2*a*, the LMRP 701 is attached to a drill rig (not shown) by a riser pipe assembly, for example in order to provide a guide for a drill stem of the drill rig to the wellhead assembly 201 and to conduct drilling fluid from the well to the drill rig. The riser pipe assembly comprises, in sequence: a riser pipe 701*a* which extends toward the LMRP 701 from the drill rig; a riser adapter 701*b*; an emergency release coupling 701*c*, disposed above the upper module 607 and arranged to allow the riser pipe 701*a* to pull or break free from the LMRP 701 in its line of direction with no angular moments or adjustment; and a pivot joint 701*d*, disposed within and supported by the upper module 607.

Figure 2C:
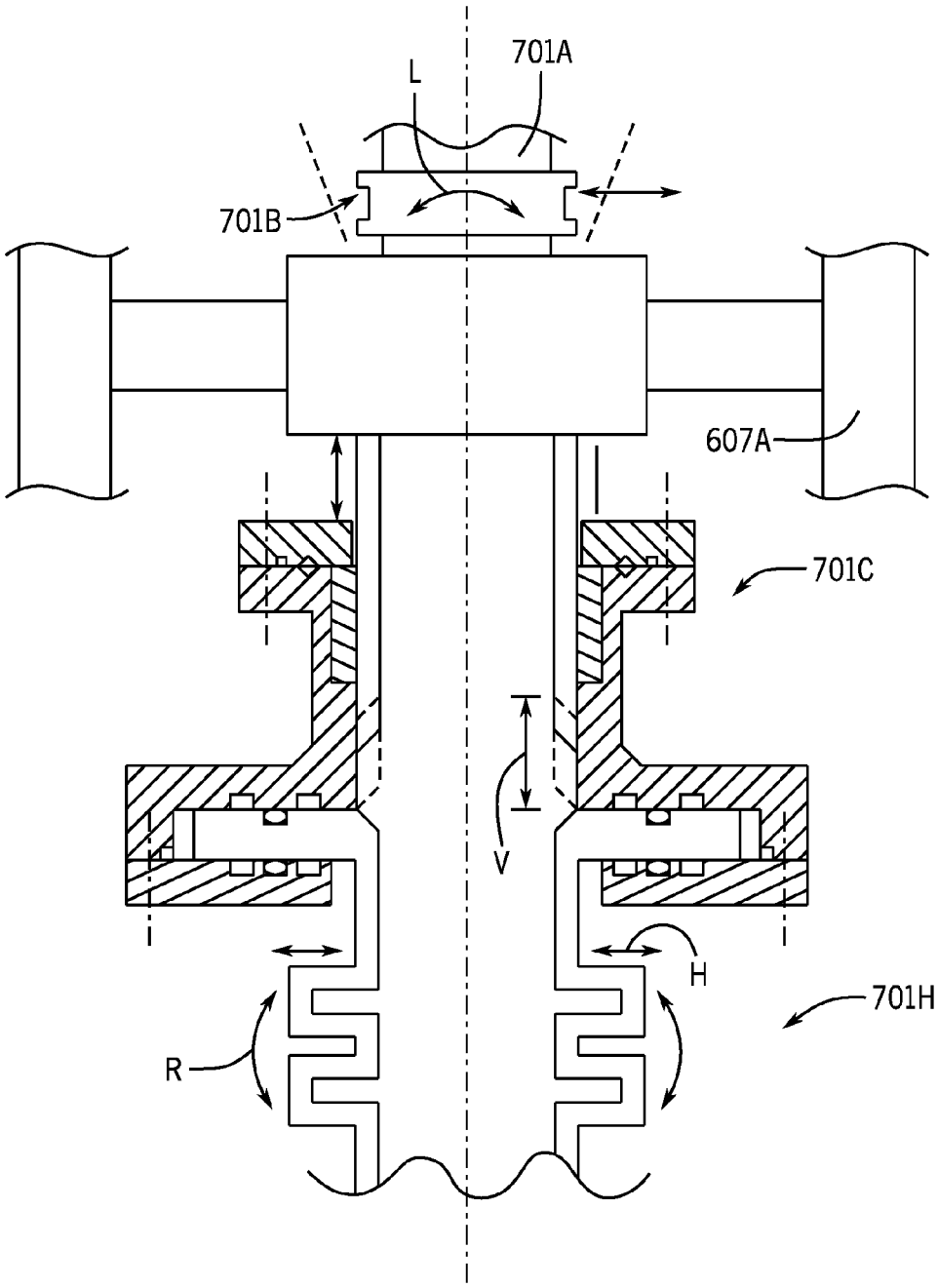

Referring also to an exemplary embodiment shown in FIG. 2*c*, to accommodate lateral movement or compliance (i.e. generally normal to the vertical axis Z, arrow L in FIG. 2*c*) between the lower module 605 and the upper module 607, due to forces from the riser pipe 701*a* and vertical flexibility (arrow V in FIG. 2*c*) of the subsea component 501, a telescopic joint 701*e* is disposed within and supported by the upper module 607 close to an upper annular 701*f*. Below the telescopic joint 701*e* is a compliant pressure-containing, laterally-and-rotationally-movable unit 701*h* to allow horizontal and rotational compliance (arrows H, R in FIG. 2*c*) between the upper module 607 and subsea component 501.

Figure 2D:
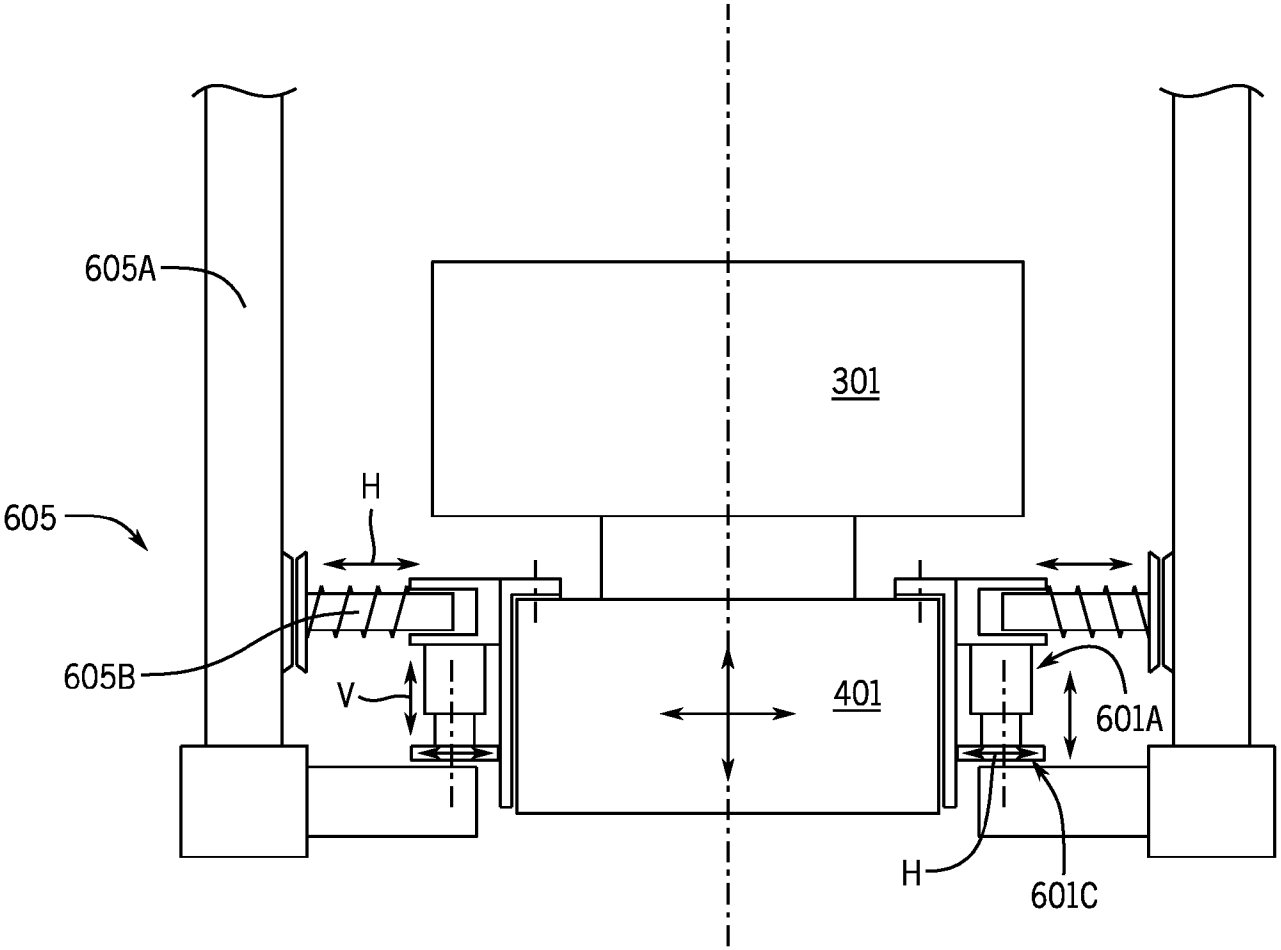

Referring also now to FIG. 2*d*, in this embodiment the structural support 601 includes telescopic hydraulic jacks 601*a*, disposed at the interface between the connector 401 and the wellhead assembly 201, and at the interface at the LMRP 701 connector 701*g*, and arranged to provide a "soft-landing" for these components as they are lowered down on to the preinstalled structural support lower module 605. The telescopic hydraulic jacks 601*a* allow the BOP assembly 301 to be held high when the lower module 605 is landed on the base 603 and connected. The BOP assembly 301 can then be lowered and connected to the wellhead 201 (arrow V in FIG. 2*d*). The telescopic hydraulic jacks 601*a* are secured at their upper section and include foot plates, or skid rings, 601*c* which allow sliding in the horizontal direction (arrow h in FIG. 2*d*). Each of the compliant connectors 605*b*, 607*b* comprises a spring load buffer, which may be preloaded. The compliant connectors 605*b* exert a horizontal force (arrow H in FIG. 2*d*) on the BOP assembly 301 to keep it compliantly central but allowing it to move up and down. The compliant connectors 607*b* exert a horizontal force on the lower section of the LMRP 701, below the telescopic joint 701*e*, and allow the connector 701*g* to be held high while the tubular elements 607*a* are landed and locked to the tubular elements 605*a* of the lower module 605. The connector 701*g* can then be lowered and locked to the BOP assembly 301 (preventer stack).

Figure 3:
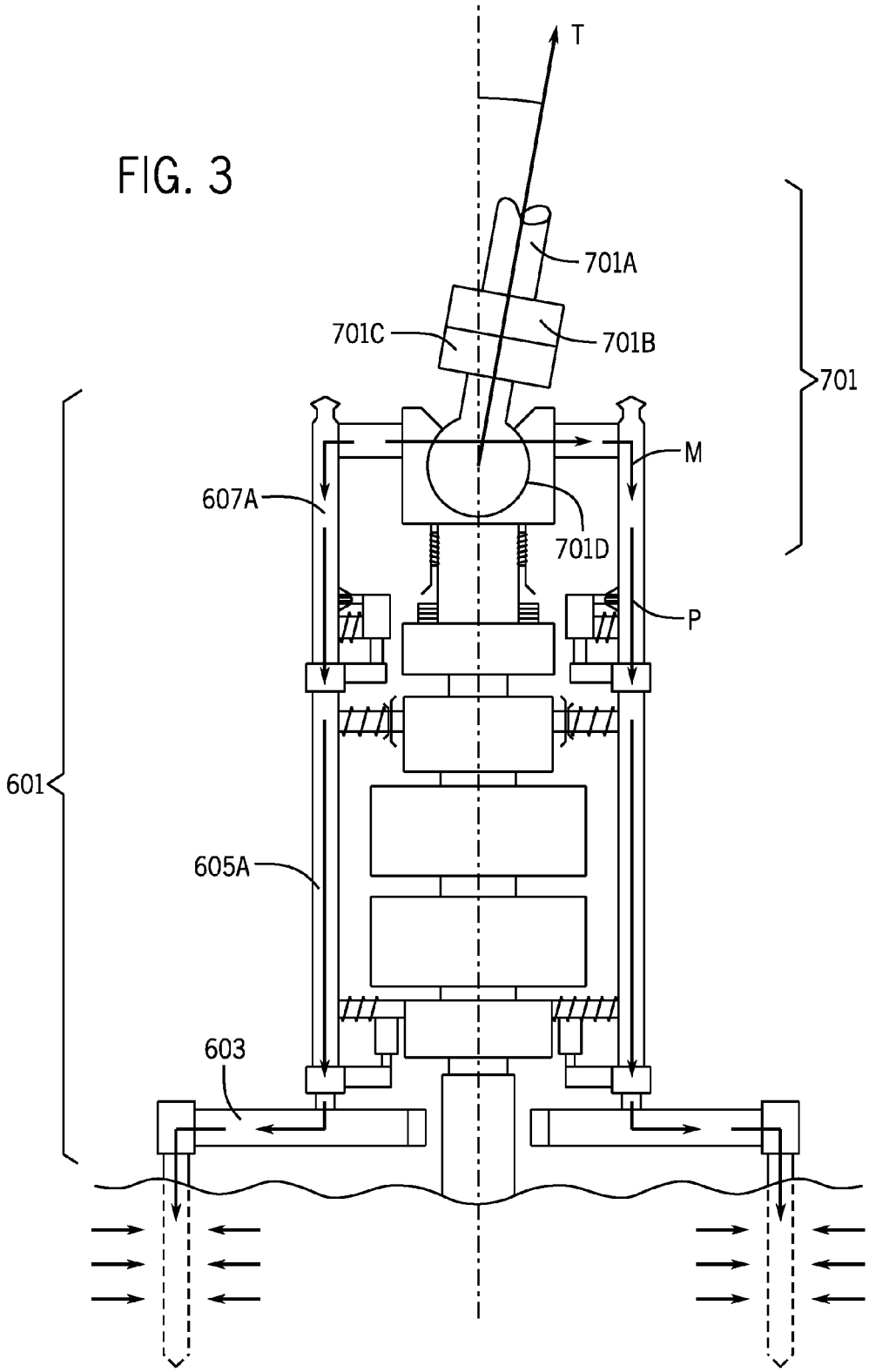
FIG. 3 shows a path taken by loads applied to the subsea support system of FIGS. 2*a-d;*

The in-service operation of the structural support 601 will now be described, with particular reference to FIG. 3. Initially, a drill rig (or similar vessel) is located directly over the well such that the riser pipe 701*a*, which connects the drill rig to the LMRP 701, lies along the vertical axis Z. In this condition, the riser pipe 701*a* is subjected to a predominantly tensile force. The drill rig may be moved away from its spot directly over the well, for example by wind, waves or ocean currents, and, accordingly, the riser pipe 701*a* is deflected so as to lie at an angle Theta from the vertical axis Z. Up to a point, the lateral and longitudinal deflections of the riser pipe 701*a* are accommodated by the pivot joint 701*d*, such that the horizontal component of the tensile load T does not lead to significant forces on the structural support 601.

If the drill rig then strays even further from the center of the well, the pivot joint 701*d* will exert extreme forces or reach the limits of its travel and the increasing horizontal component of the tensile load T will now be transferred to the structural support 601. Accordingly, a bending moment M is applied to the structural support 601, with the mechanical load taking a path P through the riser pipe 701*a*, riser adapter 701*b*, emergency release coupling 701*c*, pivot joint 701*d*, upper module 607, lower module 605, and base 603, into the seabed. If the bending moment M is sufficient, the structural support 601 may be appreciably moved or even deformed, but, due to the load-absorbing compliant connectors 605*b*, 607*b*, the load is not transferred to the subsea component 501 or the pipe 101. It will be understood that the "floating" connection to the structural support 601 is capable of horizontal, vertical and rotational compliance. Under a bending load, one side of the structural support 601 will be subjected to compression while the other side will experience tension, and the compliant connectors 605*b*, 607*b* accommodate this. Thus, the pressure-critical elements of the well are isolated and protected from the effects of the applied mechanical load and fatigue damage may be avoided.

The level of strain or distortion in the structural support 601 may be detected by the sensors 601*b* and supplied to a processor (not shown), configured to compare the detected level with a predetermined threshold value and, if appropriate, intervene to prevent damage to the well. For example, the riser pipe 701*a* may be released, and thereby the mechanical load removed, by activating the emergency release coupling 701*c*. The sensors 601*b* may detect the displacement of the structural support 601 from a vertical datum, which is determined by the verticality of the system elements, for example the BOP stack assembly 301. If these elements begin to flex, bend or twist under load, a warning may be sent to the drill rig and an emergency release may be performed to prevent damage to the elements.

In an embodiment, which is capable of distributing the mechanical loads over an even larger area of seabed, an array of piles or anchors in the seabed are connected to the structural support by tension members, for example taut cables or chains.

Figure 4:
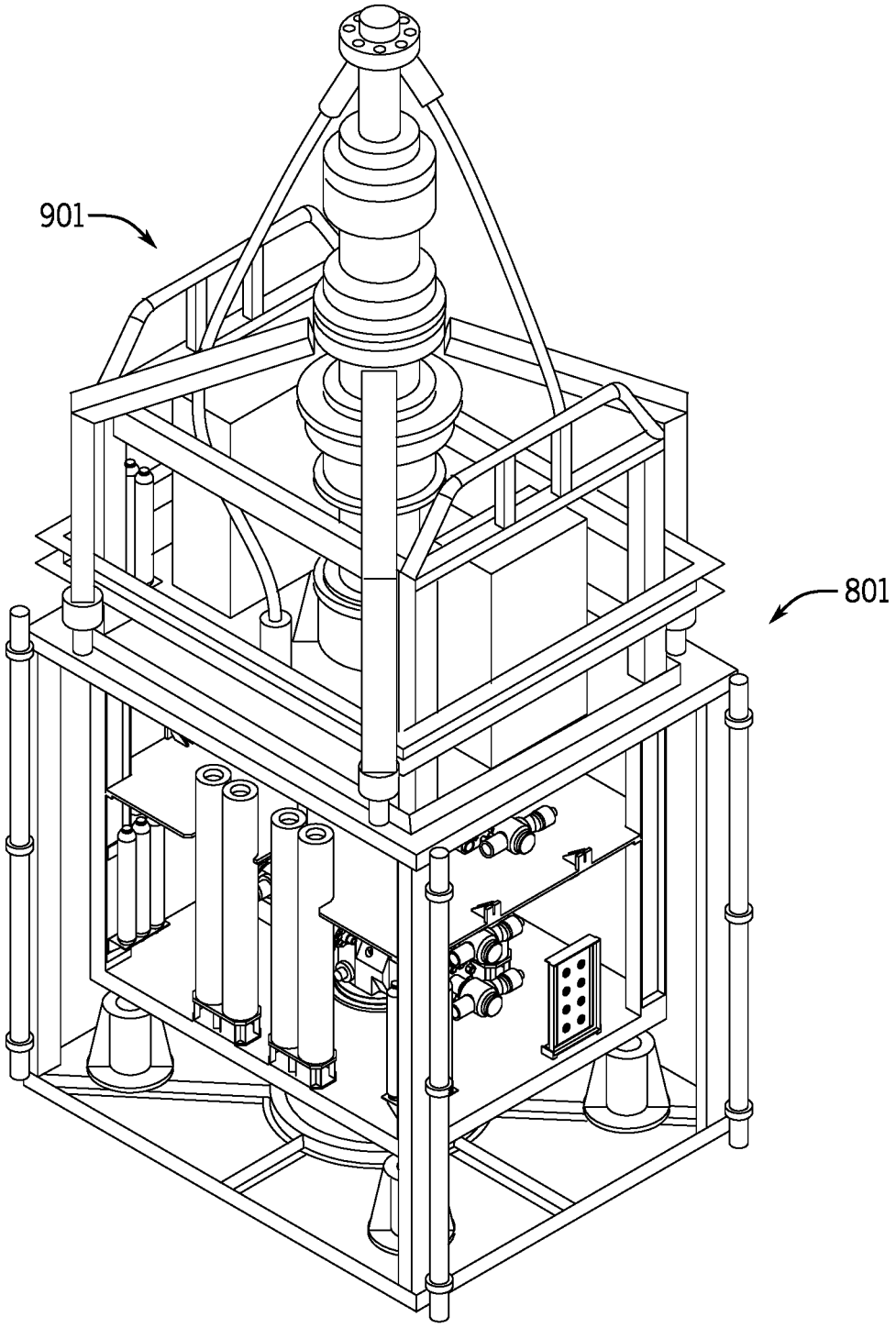
FIGS. 4 and 5 illustrate alternative embodiments of elements of a subsea support system in accordance with the invention.

Referring to FIG. 4, in an embodiment a structural support 801 in accordance with the invention is configured to accept a complete conventional BOP stack 901.

While embodiments of the invention have been described herein above with respect to support of a pressure-handling component (BOP stack assembly), it will be understood by the skilled reader that the subsea support is suitable for protecting other types of well component from mechanical loads. Examples include, but are not limited to vertical caisson separators, and piles for pipeline heads, where riser intervention on sea bed fixed assemblies with critical formation constraints that must not be exposed to external forces from risers or snagging loads on the structures.

Regarding a drilling BOP assembly, three pressure specification breaks may be considered, as follows. The rams can be considered a high pressure (HP) to the rating of the BOP. The annulars are bag type rams and cannot achieve the same pressure rating as rams so can be considered as medium pressure (MP). The drilling riser is only designed to act as a conduit to the rig and to contain the mud column so can be considered as low pressure (LP). This realization leads to the structural design and positioning of the telescopic joint 701*e* and compliant member 701*h*.

Figure 5:
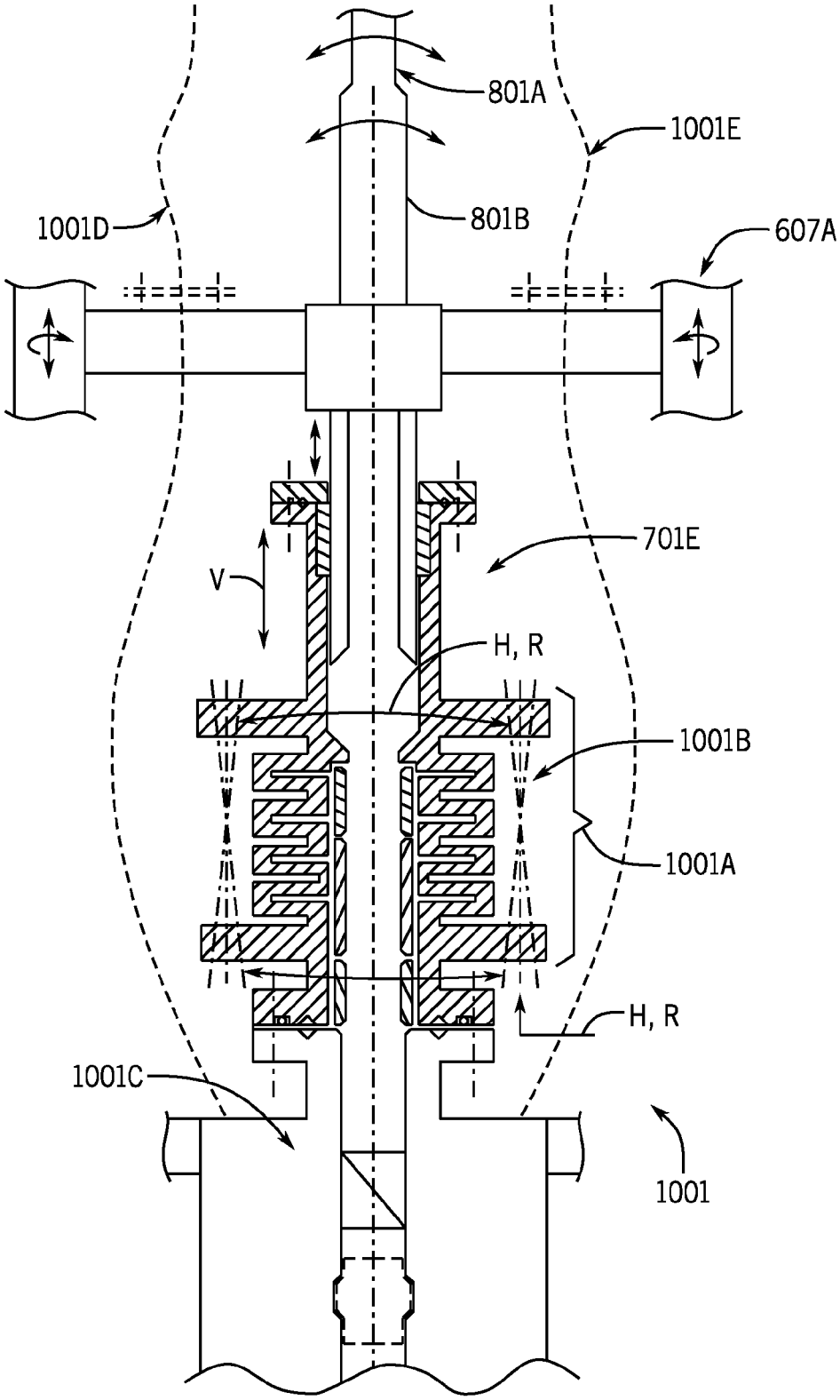

Referring to FIG. 5, in a subsea tree and emergency disconnect package (EDP) 1001 there are no specification breaks and the whole system including the HP riser have to be rated for the tree pressure. Therefore, in this configuration, there is no ball joint as this will not take the pressure. Instead, movement of the riser 801*a* can be accommodated by use of stiff joints 801*b* above the EDP. Therefore the tree/EDP can be subjected to high bending moments. For example, the pivot joint may be replaced by a high pressure bellows unit 1001*a*, to provide horizontal and rotational compliance (arrows H, R in FIG. 5). In this embodiment, the bellows unit 1001*a* includes tension ties 1001*b* to compensate for pressure effects. In this embodiment, EDP valve units 1001*c* are connected to an annulus flexible pipe 1001*d* and an umbilical control line 1001*e*.

It will be understood that the invention has been described in relation to its preferred embodiments and may be modified in many different ways without departing from the scope of the invention as defined by the accompanying claims. For instance, regarding the exemplary embodiments, references to the number or specific form of structural parts, such as formation penetrations, legs, feet, tubular elements and I-beams, are for illustrative purposes only and are not to be interpreted as limiting of the invention.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A subsea support system, comprising:

at least one component configured to be fixedly connected to a pressure conductor in a seabed; and a subsea support disposed at least partially about the at least one component, wherein the subsea support comprises at least one compliant element positioned at an offset from a central axis of the at least one component, and the at least one compliant element is configured to compliantly support the at least one component;

wherein, when the at least one component is fixedly connected to the pressure conductor, substantially all of a mechanical load applied to the subsea support is transmitted by the subsea support to the seabed while the at least one component is substantially free of the mechanical load and remains fixed relative to the pressure conductor.

2. The subsea support system according to claim 1, wherein the at least one compliant element is configured to enable translation of the subsea support relative to the at least one component under the mechanical load.

3. The subsea support system according to claim 1, wherein the at least one compliant element is configured to enable rotation of the subsea support relative to the at least one component under the mechanical load.

4. The subsea support system according to claim 1, wherein the at least one component is a pressure-containing component, which is configured to be fluidly connected to the pressure conductor.

5. The subsea support system according to claim 4, wherein the pressure-containing component is configured to control the pressure of a fluid received from the pressure conductor, and the pressure-containing component comprises a fluid shut-off and/or a circulation module configured to control a well drilling fluid and/or formation fluid.

6. The subsea support system according to claim 4, wherein the pressure-containing component is configured to control the pressure of a fluid received from the pressure conductor, and the subsea support system is configured to control the fluid in the pressure-containing component when the mechanical load applied to the subsea support exceeds a predetermined value.

7. The subsea support system according to claim 6, comprising sensors configured to detect the predetermined value of the mechanical load.

8. The subsea support system according to claim 4, wherein the pressure-containing component comprises a blow-out preventer (BOP), a wellhead, a subsea production tree, a manifold, an emergency disconnect package (EDP), a lower marine riser package (LMRP), or a combination thereof.

9. The subsea support system according to claim 1, comprising a connection configured to connect the subsea support to a conduit or line configured to apply the mechanical load, wherein the connection comprises a pivot and/or telescopic connection configured to enable bending or translation of the subsea support relative to the at least one component.

10. The subsea support system according to claim 1, comprising a connection configured to connect the subsea support to a conduit or line configured to apply the mechanical load, and a coupling is configured to separate the conduit or line from the subsea support at a predetermined value of the mechanical load.

11. The subsea support system according to claim 1, comprising a bellows.

12. The subsea support system according to claim 1, comprising a pivot joint and a telescopic joint.

13. The subsea support system according to claim 1, wherein the at least one component comprises a plurality of the components, and the subsea support comprises a plurality of stackable elements or modules configured to support the plurality of components.

14. The subsea support system according to claim 13, wherein the at least one compliant element comprises one or more compliant elements coupled to each of the plurality of stackable elements or modules.

15. A system, comprising:

a subsea support configured to support at least one component fixedly connected to a pressure conductor in a seabed, wherein the subsea support comprises:

a support structure configured to be positioned at least partially about the at least one component; and at least one compliant element configured to be positioned at an offset from a central axis of the at least one component, wherein the at least one compliant element is configured to compliantly support the at least one component, so that substantially all of an external mechanical load applied to the subsea support is transmitted by the subsea support to the seabed while the at least one component is substantially free of the external mechanical load and remains fixed relative to the pressure conductor.

16. The system of claim 15, wherein the at least one compliant element extends along an axis crosswise to the central axis of the at least one component.

17. The system of claim 15, wherein the at least one compliant element comprises a plurality of compliant elements circumferentially spaced about the central axis.

18. The system of claim 15, wherein the at least one compliant element comprises a plurality of compliant elements axially spaced at different axial positions along the central axis.

19. The system of claim 15, wherein the at least one compliant element comprises a spring.

20. A system, comprising:

a subsea support configured to support at least one component coupled to a tubing in a seabed, wherein the subsea support comprises:

a support structure configured to couple to the seabed; and at least one compliant element coupled to the support structure, wherein the at least one compliant element is configured to enable movement of the support structure relative to the at least one component in response to an external mechanical load.

* * * * *